United States Patent [19]

Paxton

[11] 4,294,536

[45] Oct. 13, 1981

[54] AUTOMATIC CONTROL OF COPIER COPY CONTRAST AND DENSITY FOR PRODUCTION RUNS

[75] Inventor: Kenneth B. Paxton, Webster, N.Y.

[73] Assignee: Eastman Kodak Company, Rochester, N.Y.

[21] Appl. No.: 154,747

[22] Filed: May 30, 1980

[51] Int. Cl.[3] ..... G03G 15/00

[52] U.S. Cl. ..... 355/14 C; 355/14 D; 355/14 E; 355/77

[58] Field of Search ..... 355/14 C, 14 D, 14 E, 355/14 R, 3 R, 77, 3 DD

[56] References Cited

U.S. PATENT DOCUMENTS 4,109,313 8/1978 Donohue et al. ..... 355/14 C

*Primary Examiner*—Richard L. Moses

*Attorney, Agent, or Firm*—Raymond L. Owens

[57] ABSTRACT

In aparatus having a document feeder coupled to a copier for producing a production run of a multi-sheet document, a memory stores the location in the document of each particular document sheet having a copy characteristic that is substantially different from the other sheets, and copier process parameter information for controlling the contrast and density of copies corresponding to the sheets of the multi-sheet document including such particular document sheet. Logic and control means coupled to the memory operates the feeder to feed seriatim document sheets to the exposure platen where they are exposed for copying to produce a copy production run. The logic and control means adjusts copier parameters so that copies corresponding to such particular document sheet have contrast and density in accordance with the stored copy processing parameter information.

12 Claims, 4 Drawing Figures

PRINTING CONTROLS

AUTOMATIC CONTROL OF COPIER COPY CONTRAST AND DENSITY FOR PRODUCTION RUNS

CROSS-REFERENCE TO RELATED APPLICATIONS

Reference is made to commonly assigned U.S. patent application Ser. No. 137,149 filed Apr. 4, 1980, entitled COPY CONTRAST AND DENSITY CONTROL to Fiske et al, and to commonly assigned U.S. patent application Ser. No. 133,077 filed Mar. 24, 1980, entitled METHOD AND MEANS FOR IMPROVING MAXIMUM DENSITY AND TONAL RANGE OF ELECTROGRAPHIC IMAGES to Kasper et al, the disclosures of which are incorporated by reference herein.

BACKGROUND OF THE INVENTION

1. Field of the Invention

The present invention relates to copiers having automatic document feeders which produce production runs of multi-sheet documents.

2. Description of the Prior Art

The term contrast, as used herein, refers to the rate of change (or slope) of the output copy density Dout with respect to the input copy density Din.

High-speed copiers having automatic feeders are currently in use to produce production runs. In one example, a recirculating feeder is coupled to a copier and causes the copier to make collated copies of a multi-sheet document. The recirculating feeder automatically feeds individual sheets in succession from the bottom of a document stack (a multi-sheet document in the feeder tray) to the exposure platen and returns such sheet to the top of the document stack while maintaining the original orientation. After each sheet of a document stack has been fed once, the document stack can either be fed again or removed from the feeder. Since the copy sheets are delivered from the copier in the same order as the original document sheets, collation of the production run copy sheets by a sorter accessory is unnecessary.

Occasionally, a sheet of the document stack will have a contrast or density which when copied by the copier in normal operation will produce a poor copy. In this case, the practice is to remove this document sheet from the document stack and copy it individually, making an intermediate or master copy. The copy master is then returned to the appropriate position in the document stack and the production run undertaken. A problem with this arrangement is that during the production run when the copy master is copied, (making a copy of a copy), image quality may be unavoidably degraded.

In order to make the copy master, several techniques may be used to adjust the electrophotographic process to provide the master copy with improved contrast and density.

In one technique for making copy masters, halftone screens, including halftone tint screens, are used to improve the contrast and density of certain difficult-to-reproduce images. Halftone tint screens have opaque dots of uniform density. Typical screening techniques for producing half-toned copies of continuous images or of large image areas of uniform density generally involve inserting a screen in the optical path which transforms the image into a plurality of dots or lines which can then be developed. Such discrete charge bearing zones in the form of dots, lines or other subdivisions of such images hereinafter referred to as "charge islands", are separated by "open areas" bearing little or no charge relative to the charge islands. Electrostatic charge images comprising such charge islands also can be created by initially charging the electrographic surface in a screen pattern, by masking the original image with a halftone screen during image exposure, or by uniformly exposing a charged photoconductive surface through a halftone screen before, during, or after image exposure, but before development. For examples of such screening techniques, see U.S. Pat. Nos. 2,598,732 and 3,724,944.

In the above-identified commonly assigned patent application to Kasper et al, a halftone screen is included as an integral part of the photoconductive element. This arrangement offers several advantages including (1) minimizing registration problems and use of simple continuous exposure techniques since the screen moves with the photoconductive layer, (2) a fixed space is maintained between the screen pattern and the photoconductive layer and, (3) high frequency screen patterns may be used without significant resolution loss.

Another contrast and density technique is set forth in commonly assigned U.S. patent application Ser. No. 137,149, entitled Copy Contrast and Density Control, filed Apr. 4, 1980 to Fiske et al. The disclosed apparatus adjusts copier process parameters to produce copies having improved copy contrast and density. A memory has a stored matrix array of sets, with each set having values which correspond to specific levels of Vo, Eo, and $V_B$ respectively. The operator designates a particular set. Means responsive to the values of the designated set change the exposure Eo produced by exposure lamps, the voltage Vo applied onto the surface of a photoconductor by a charger and the bias $V_B$ applied to an electrode of a development station to provide a copy having improved contrast and density.

SUMMARY OF THE INVENTION

In accordance with the invention, contrast and density of copies of particular document sheets of a multi-sheet document is adjusted during production runs but without making copy masters.

Before the production run, an operator designates either a screen and/or other process parameter information such as the voltage Vo applied on photoconductor, the flash lamp intensity Eo and the development station bias $V_B$ for controlling the contrast and density of a copy for a particular document sheet having a copy characteristic that is substantially different from the other document sheets. This information is stored in memory located in the copier. Logic and control means, during the production run, causes the feeder to sequentially transport document sheets to the exposure platen of the copier where they are copied and in accordance with the stored information activates a screen and/or otherwise adjusts the copier process for producing improved copy contrast and density of the copies of such particular document sheet.

DESCRIPTION OF THE PREFERRED EMBODIMENT

To assist in understanding the present invention, it will be useful to consider an electrophotographic copier having a logic and control unit, and a recirculating document feeder. At the outset, it will be noted that although this invention is suitable for use with a recirculating feeder, it also can be used with other types of feeders. Whenever the term "document sheet" is used, it refers to particular mediums such as sheets having images to be copied. The term "document" refers to a plurality of document sheets that are to be copied during a production run. The term "copy" refers to the output of the copier such as a copy sheet having a fixed toner image.

Recirculating Feeder

Figure 1:
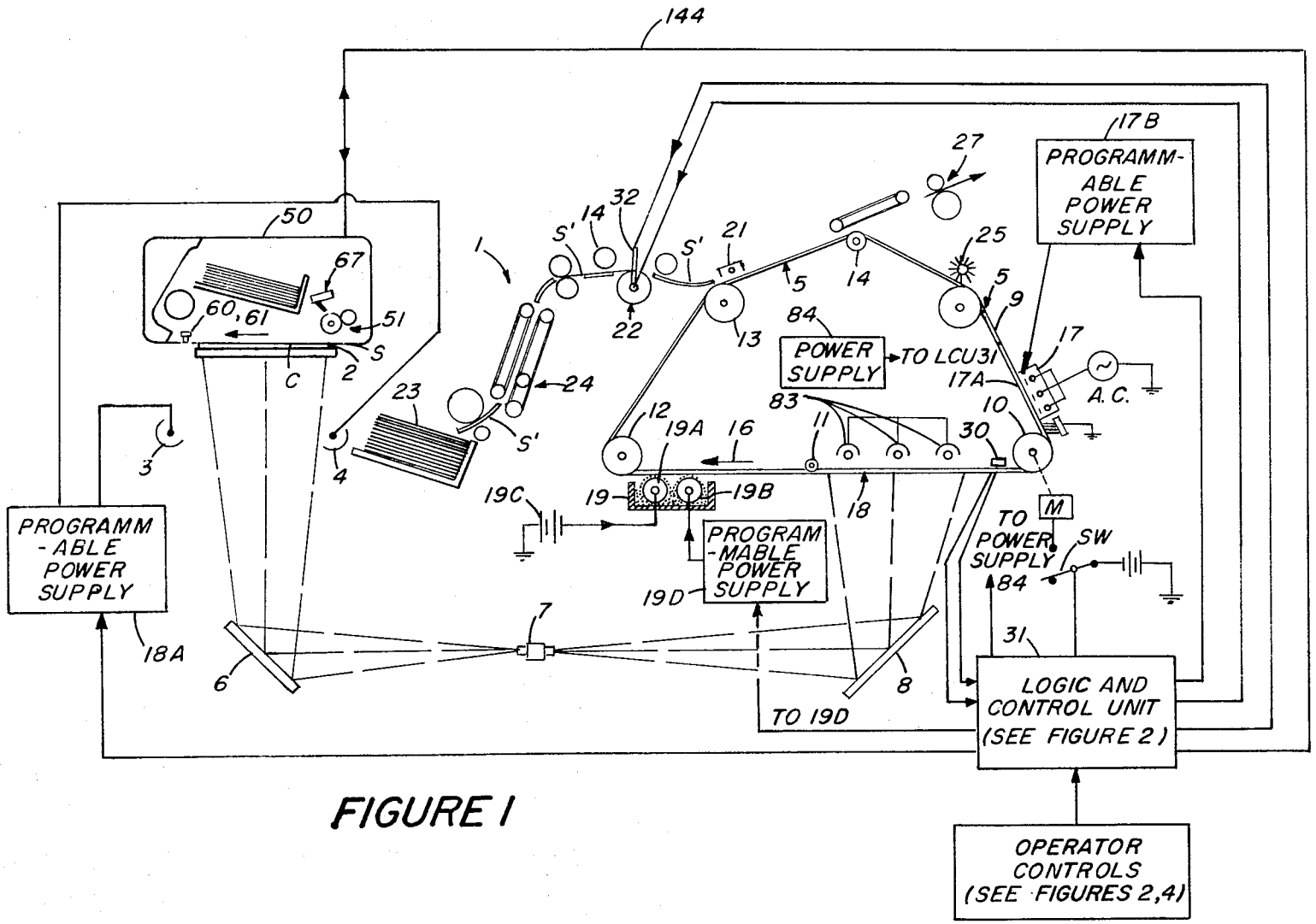
FIG. 1 is a schematic showing a side elevational view of a copier, feeder, and a logic and control unit in accordance with the invention.

In FIG. 1, a recirculating feeder 50 is positioned on top of an exposure platen 2 of a copier 1. The recirculating feeder may be similar to that disclosed in commonly assigned U.S. Pat. No. 4,076,408, issued Feb. 28, 1979, wherein a plurality of document sheets having images only on first sides of such sheets can be repeatedly fed seriatim from an originating document or stack to the exposure platen 2.

The feeder 50 includes feed rollers 51 which transport a document sheet S across the exposure platen 2 to document registration blocks 60 and 61, which stop and register the document on the exposure platen. The platen 2 is constructed of transparent glass. When energized, two xenon flashlamps 3 and 4 flash illuminate the document sheet S. For a specific disclosure of a typical exposure station, see commonly assigned U.S. Pat. No. 3,998,541, issued Dec. 31, 1976. By means of an object mirror 6, lens system 7, and an image mirror 8, an image of the illuminated document is optically stopped on discrete image areas of a moving photoconductor shown as a photoconductive web 5. After a document sheet is illuminated, the blocks 60 and 61 are withdrawn from the path of travel of the documents and the document sheet is returned to the top of the document or stack in a tray.

Web

Figure 3:
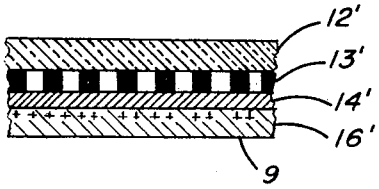
FIG. 3 shows an enlaged cross-section of the photoconductive web of FIG. 1, which includes an integral screen.

FIG. 3 illustrates a partial cross-section of the photoconductive web 5 which includes a transparent support 12', a screen 13', a conductive layer 14', and a photoconductive layer 16'. The support 12' provides mechanical strength to the other layers of the web and makes it suitable for use in electrophotographic copying machines.

The support 12' may be fabricated of almost any transparent material, either conductive or insulating, and may be selected from such diverse materials as glass and plastics of various types. The support is flexible and may be made of polyethylene, polyethylene terephthalate or the like. Although a transparent support is used in this illustrative embodiment of the invention, other types of support can be used, especially in circumstances where the photoconductive layer 16' is exposed other than through the support.

In the disclosed embodiment, immediately adjacent to the support 12', which is transparent, is the halftone screen 13', which is made up of a number of finely divided, alternating, opaque and transparent areas. This screen is used to form the charge islands on the photoconductive layer 16'. The screen pattern of opaque and transpaent areas may be a conventional dot pattern or line pattern of the type used for the fabrication of halftone plates for newspaper printing. The alternating opaque and transparent areas of the screen pattern may be of almost any shape, including round dots, elliptical dots, lines and the like. The spacings of the pattern may also vary so that the pattern is regular, irregular, or random. The pattern may also be varied in size from dot-to-dot or line-to-line. Since the screen pattern is utilized only for forming charge islands, the screen may be either electrically conducting or insulating. To minimize moire patterns when copying images that already contain conventionally oriented 45° black and white halftone patterns, the halftone screen preferably oriented such that after uniform exposure through the web support, the resultant halftone pattern is at an angle of from 30° to 10° from the latent image halftone pattern of the original halftone image on the document sheet being copied.

When halftone screens are used, the screen may have almost any frequency. The halftone screen may be located in the film base as disclosed in U.S. Pat. Nos. 3,310,401 and 3,335,003; it can be integral with the conductive layer as disclosed in Canadian Pat. No. 577,137 and German Pat. No. 1,572,374; in the barrier layer as disclosed in U.S. Pat. No. 3,341,326; as an overcoat over the photoconductive layer as disclosed in U.S. Pat. No. 3,627,526 and Canadian Pat. No. 906,802 or integral with the photoconductive layer as disclosed in U.S. Pat. No. 3,681,07, or French Pat. No. 1,373,910. Methods for producing electrophotographic images using screen techniques are well known. Such methods are disclosed in the aforementioned U.S. patents. Particularly useful results are obtained with halftone tint screens having a frequency of about 32 to about 80 dots/cm and a percent tint i.e. percent opaque areas of about 10 to 90%.

Although a halftone screen is used in this illustrative embodiment to form charge islands in the electrostatic image other means can be used for this purpose. For example, charge islands can be formed by corona charging or discharge through a screen such as a grid-controlled charging screen or insulator screen or pulsed corona charge through a longitudinal screen as disclosed in U.S. Pat. No. 3,449,568; by charging with a patterned array of pulsed styli or wires as disclosed in U.S. Pat. No. 2,932,742; by discharging the photoconductive layer with a textured conducting roller as disclosed in U.S. Pat. No. 3,248,216; or by discharging via a voltage contrast patterned layer beneath the photoconductive layer as disclosed in U.S. Pat. No. 3,341,326.

Latent electrostatic images composed of charge islands may also be formed with a single exposure by using a scanning type exposure device such as a computer addressed light emitting diode array, cathode ray tube or laser. The continuous tone image may be momentarily or permanently stored in binary form in a computer memory. When it is desired to reproduce the continuous tone image, the proper output transducer circuits between the computer's memory and the exposure means are activated. The computer's logic controls the transducer circuits in a way to cause the cathode ray tube, laser or light emitting diode array to modulate and/or pulse on and off according to the tonal range of the continuous tone images, while scanning, and thus, exposing a photoconductor. This exposure of the photoconductor results in a latent electrostatic image comprising charge islands of varying charge levels. Method and means for accomplishing a latent image comprising charge islands of varying charge intensity with scanning devices are disclosed in U.S. Pat. No. 3,864,697 (laser) granted Feb. 4, 1975 to Dillon et al; U.S. Pat. No. 4,025,189 (light emitting diode array) granted May 24, 1977 to Pugsley et al; and U.S. Pat. No. 3,681,777 (cathode ray tube) granted Aug. 1, 1972 to Smura et al.

Immediately adjacent to the halftone screen 13' is the conductive layer 14 which may, for example, be composed of a very thin transparent layer of tin oxide, nickel, cermet, or copper iodide. Methods for forming such conductive layers are well known. Conductive layers are fully described for example in U.S. Pat. Nos. 2,429,420 to McMaster, 2,769,778 to Preston, 2,772,190 to Haayman, and 2,756,165 to Lyon.

Optionally, an electrical or chemical barrier layer may be used in combination with the conducting layer 14 and the halftone screen 13'.

The photoconductive layer 16' may be composed of any of the photoconductive insulating materials generally used in electrophotography, and may include such diverse materials as vitreous selenium, aggregate photoconductive layers of the type disclosed in U.S. Pat. No. 3,615,414 to Light or any one of many other organic photoconductor layers including multi-layer photoconductive structures having separate charge generating and charge transport functions.

Electrophotographic Copier

Returning to FIG. 1, the web 5 is trained about six transport rollers 10, 11, 12, 13, 14, and 15, thereby forming an endless or continuous belt. For more specific disclosures of such an arrangement, see commonly assigned U.S. Pat. Nos. 3,615,406 and 3,615,414, both issued Oct. 26, 1971. Roller 10 is coupled to a drive motor M in a conventional manner. Motor M is connected to a source of potential V when a switch SW is closed by a logic and control unit (LCU) 31. When the switch SW is closed, the roller 10 is driven by the motor M and moves the web 5 in clockwise direction as indicated by arrow 16. This movement causes successive image areas of the web 5 to sequentially pass a series of electrophotographic work stations of the copier.

For the purpose of the instant disclosure, several copier work stations are shown along the web's path. These stations will be briefly described. For more complete disclosures of them, see commonly assigned U.S. Pat. No. 3,914,047.

First, a charging station 17 is provided at which the photoconductive surface 9 of the web 5 is sensitized by applying to such surface an electrostatic charge of a predetermined voltage. The station 17 includes an A.C. charger shown as a three wire A.C. charger. The output of the charger is controlled by a grid 17A connected to a programmable power supply 17B. The supply 17B is in turn controlled by the LCU 31 to adjust the voltage level Vo applied onto the surface 9 by the charger 17 in accordance with a designated set value as will be described later. For an example of digital regulation of a corona charger, see U.S. Pat. No. 4,166,690. For some exemplary values, the grid voltage can be adjusted about a nominal value of −500 volts with a 600 hertz A.C. square signal applied to the corona wires.

At exposure station 18, the inverse image of a document sheet S is projected onto the photoconductive surface 9 of the web 5. The image dissipates the electrostatic charge at the exposed areas of the photoconductive surface 9 and forms a latent electrostatic image. A programmable power supply 18A, under the supervision of the LCU 31, controls the intensity or duration of light incident upon the web 5 to adjust the exposure level Eo by the lamps 3 and 4 in accordance with a designated set value as will be described later. For a specific example of such an exposure station and programmable power supply, see commonly assigned U.S. Pat. No. 4,150,324, issued Aug. 8, 1978 to Seil.

A dual magnetic brush developing station 19 includes developer, having iron carrier particles and electroscopic toner particles with an electrostatic charge opposite to that of the latent electrostatic image. For a specific example of such a developer, see the above-identified commonly assigned Kasper et al patent application. The developer is brushed over the photoconductive surface 9 of the web 5 and toner particles adhere to the latent electrostatic image to form a visible toner particle, transferable image. The dual-magnetic brush station 19 includes two rollers, a transport roller 19A, and a developer roller 19B. As is well understood in the art, each of the rollers 19A and 19B include a conductive (non-magnetic) applicator cylinder which may be made of aluminum. In the disclosed embodiment, conductive portions, such as the drive shaft and the applicator cylinder of the transport roller 19A, act as an electrode and are electrically connected to a source of fixed D.C. potential, shown as a battery 19C. Conductive portions of development roller 19B also act as an electrode and are electrically connected to a programmable power supply 19D controlled by the LCU 31. Power supply 19D adjusts the level of $V_B$, the voltage level applied to station electrode and will be discussed later. For a specific disclosure of a dual magnetic brush which can be used in accordance with the invention, see commonly assigned U.S. Pat. No. 3,543,720. See U.S. Pat. Nos. 3,575,505, 3,654,893, and 3,674,532 for disclosures of biasing development station rollers. See also Canadian Pat. No. 979,299.

The copier 1 also includes a transfer station shown as a corona charger 21 at which the toner image on web 5 is transferred to a copy sheet S'; and a cleaning station 25, at which the photoconductive surface 9 of the photoconductive layer 16' is cleaned of any residual toner particles remaining after the electroscopic images have been transferred and any residual electrostatic is discharged.

After transfer of the unfixed electroscopic images to a copy sheet S', such sheet is transported to fuser 27 where the image is fixed to it.

To coordinate operation of the various work stations 17, 18, 19, 21, and 25 with movement of the image areas on the web 5 past these stations, the web has a plurality of perforations along one of its edges. These perforations generally are spaced equidistantly along the edge of the web member 16. For example, the web member 5 may be divided into six image areas by F perforations; and each image area may be subdivided into 51 sections by C perforations. The relationship of the F and C perforatons to the image areas is disclosed in detail in commonly assigned U.S. Pat. No. 3,914,047. At a fixed location along the path of web movement, there is provided suitable means 30 for sensing web perforations. This sensing produces input signals into the LCU 31 which has a digital computer, preferably a microprocessor. The microprocessor has a stored program responsive to the input signals for sequentially actuating then de-actuating the work stations as well as for controlling the operation of many other machine functions as disclosed in U.S. Pat. No. 3,914,047.

Screen

As previously described, a screen may be inserted into the optical path. However, as discussed above, a screen integrally formed in the web 5 is the preferred arrangement (see FIG. 3).

As shown in FIG. 1, the web 5 is first charged by the charger 17. This charging process is carried out in darkness so that after it is completed, the surface 9 of the photoconductive layer 16' is sensitized with a generally uniform field. Image exposure is effected by flash lamps 3 and 4, and the web is exposed to an original continuous tone image to form a latent electrostatic image of a document sheet on the web. Formation of a plurality of charge islands within the latent electrostatic image is effected by second uniform exposure through the rear of the web and through the integral halftone screen 13' formed in the web. As disclosed in the commonly assigned Kasper et al application, this rear exposure may be carried out prior to, simultaneous with, or after image exposure of the photoconductor, the only requirement being that this rear exposure be carried out after charging and prior to development. A plurality of flash lamps 83 are shown to provide this rear exposure and activate the screen 13' and are energized by an adjustable power supply 84 which, in turn, is operated by the logic and control unit 31. The output of the power supply can be varied to change the exposure of the lamps 83. The lamps 83 provide a uniform rear exposure through the screen 13' and serve to at least partially discharge all areas of the photoconductive layer 16' directly opposite transparent areas of the screen 13' (see FIG. 3). This exposure forms a plurality of very small charge islands on the photoconductive layer 16'. The amount of exposure used to form these charged islands is varied according to a variety of factors including the nature of the photoconductive layer, type of developer, and mode of development, as described in detail in the commonly assigned Kasper et al application.

Logic and Control Unit (LCU)

Programming of a number of commercially available microprocessors such as INTEL model 8080 or model 8085 microprocessor (which along with others can be used in accordance with the invention), is a conventional skill well understood in the art. The following disclosure is written to enable a programmer having ordinary skill in the art to produce an appropriate control program for the microprocessor. The particular details of any such program would, of course, depend on the architecture of the designated microprocessor.

Figure 2:
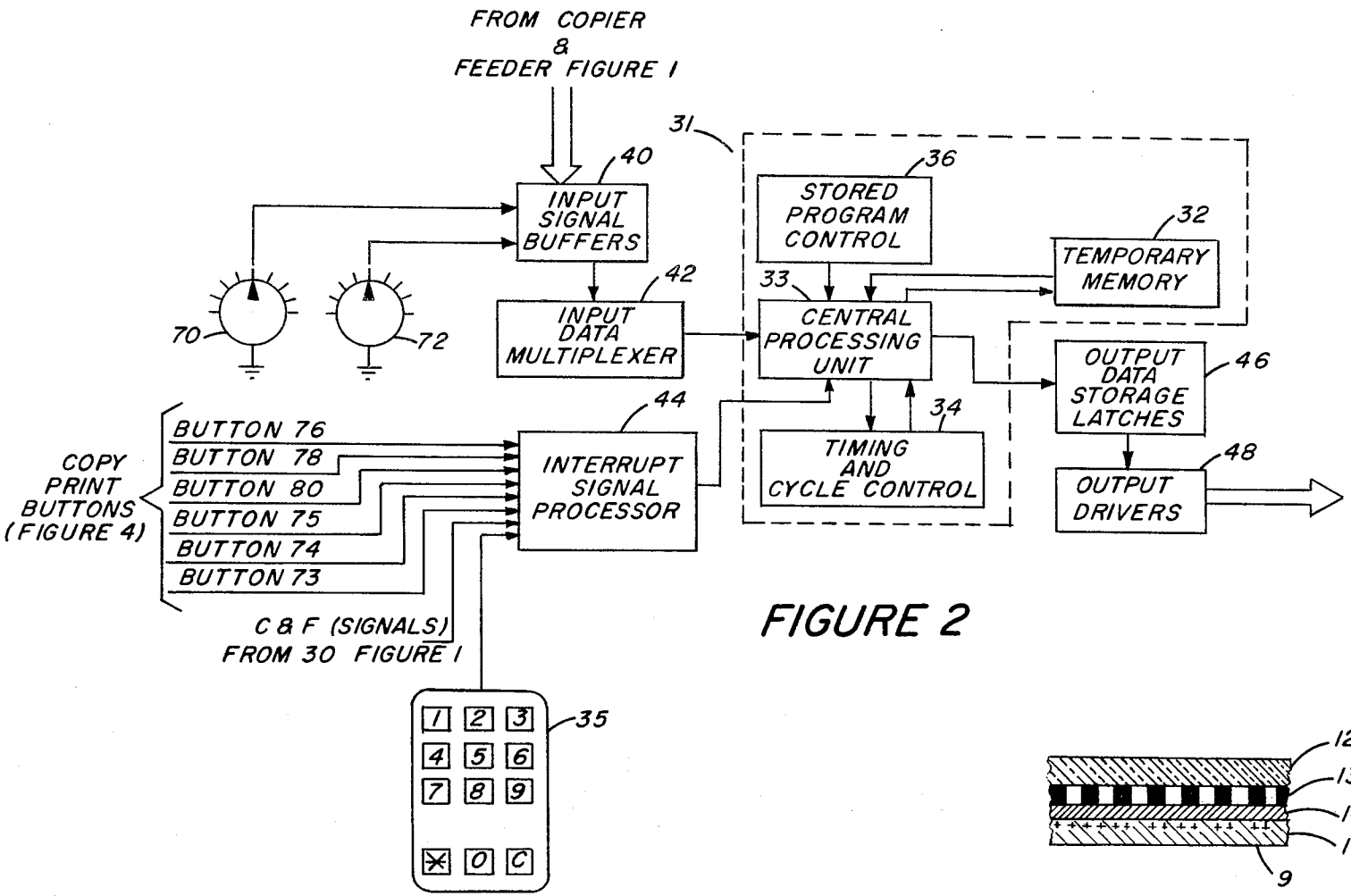
FIG. 2 is a block diagram of the logic and control unit shown in FIG. 1.

Turning now to FIG. 2, a block diagram of logic and control unit (LCU) 31 is shown which interfaces with the copier 1 and the feeder 50. Leads 144 from feeder 50 provide inputs to and receive outputs from LCU 31 to synchronize the operation of the feeder. For a more detailed disclosure of the operation and the feeder 50, see commonly assigned U.S. Pat. No. 4,099,860. The LCU 31 consists of temporary data storage memory 32, central processing unit 33, timing and cycle control unit 34, stored program unit 34, and stored program control 36. Data input and output is performed sequentially under program control. Input data are applied either through input signal buffer 40 to a multiplexer 42 or to interrupt signal processor 44. The input signals are derived from various switches, sensors, and analog-to-digital converters. The output data and control signals are applied to storage latches 46 which provide inputs to suitable output drivers 48, directly coupled to leads. These leads are connected to the work stations and to a copy sheet registration feeding mechanism 22. As shown, interrupt signals are provided by copy buttons 73, 75, 76, 78, and 80 shown in more detail in FIG. 4, and information representing a particular set of a matrix array is designated by exposure knob 70 and contrast knob 72 which provide inputs to buffers 40 via their respective analog/digital converters 71. For convenience of illustration, a copier keyboard 35 is shown connected to the interrupt signal processor 44. This keyboard 35 can conveniently be located on the operator control panel. The starred (*) button is used to enter in memory 32 the location of particular document sheets that have a different copy characteristic than other document sheets as will be described later.

Returning now to the microprocessor, stored in memory is the matrix array shown in FIG. 11 of the above-identified Fiske et al patent application. This matrix is in a digitized format, located in stored program control 36, provided by one or more conventional Read Only Memories (ROM). The ROM contains operational programs in the form of binary words corresponding to instructions and values. These programs are permanently stored in the ROM and cannot be altered by the computer operation.

The temporary storage memory 32 may be conveniently provided by a conventional, Read/Write memory or Random Access Memory (RAM).

As shown in FIG. 1, a copy sheet S' is fed from a supply 23 to continuously driven rollers 14, (only one of which is shown) which then urge the sheet against a rotating registration finger 32 of a copy sheet registration mechanism 22. When the finger rotates free of the sheet, the driving action of the rollers 14 and sheet buckle release cause the sheet to move forward onto the web 5 in alignment with a toner image at the transfer station 21.

Commonly assigned U.S. Pat. No. 4,099,860 to Connin, discloses the operation of a recirculating feeder and a copier controlled by a logic and control unit. The operation will be briefly reviewed. The feeder 50 enables the copier to make either collated or noncollated sheets of copies in a production run. In the feeder, there are a plurality of sensors. As shown in FIG. 1, there is a sensor 67, a microswitch, which is disposed adjacent to feed rollers 51 located near the tray which receives the document stack. When a document sheet passes this position, the switch 67 is closed and applies a signal to the LCU 31. After a sheet is delivered by the rollers 51 to the exposure platen, it is stopped by registration gates 60, 61 and flash exposed by lamps 3 and 4. Thereafter, it is returned to the top of the document stack. In accordance with the invention, document sheets are transported in the same fashion. However, the input signal buffers 40 receives a signal from its switch 67 as the document passes by such switch. In accordance with the invention, this signal is provided as an input to the central processing unit which counts and provides an input to the temporary memory 32 which stores a cumulative total count. When a particular sheet which has processing parameter information corresponding to it stored in temporary memory 32 passes by the switch 67, the microcomputer 31 activates the screen 13' by energizing lamps 83 and/or making adjustments to the copier to vary other process parameters. Such other adjustment can be the voltage Vo, the copier exposure Eo, and the development station electrical bias $V_B$ as disclosed in the above-identified Fiske et al patent application. The document sheet is then exposed and returned to the stack. The LCU 31 then adjusts the copier, returning it to a normal copy making mode of operation. The document sheet feeding and copying process is repeated until all such sheets are copied, the desired number of times. The copier operating set-up procedure for operating the copier in accordance with the invention will be described later under the section entitled: OPERATION.

Contrast and Exposure Control (Vo, Eo, and VB)

For a detailed explanation of the theory of copier contrast and exposure control by controlling Vo, Eo, and $V_B$, reference may be made to the following article: Paxton, Electrophotographic Systems Solid Area Response Model, 22 Photographic Science and Engineering 150 (May/June 1978). Din refers to original document reflective density, and Dout refers to copy reflective density. To facilitate understanding, the following terms are defined:

$V_B$=Developer roller bias.

Vo=Initial voltage (relative to ground) on the photoconductor just after the charger 17.

$V_F$=Photoconductive voltage (relative to ground) just after exposure by flash lamps.

E=Actual exposure of photoconductor. (Light produced by the flash lamps (Eo) is reflected off of a portion of a document having a particular density Din onto the photoconductor and causes a particular level of exposure E of the photoconductor.

Contrast and density control is achieved by the choice of the levels of Vo, Eo, and $V_B$. An operator, by adjusting knobs 70 and 72, can designate contrast and density for a particular document sheet. The operation is described in detail in the above-identified Fiske et al patent application.

Operator Controls

Figure 4:
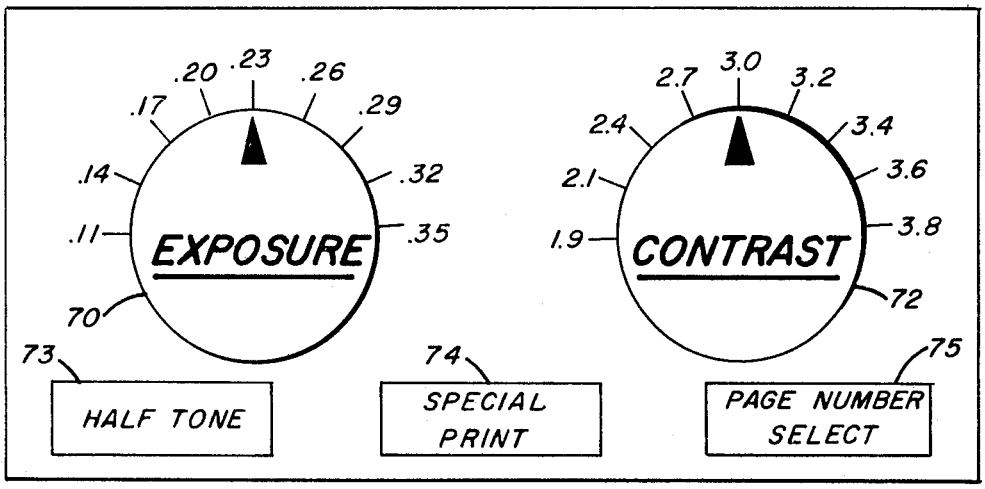
FIG. 4 shows copier controls for operating the apparatus of FIG. 1.
Figure 4:
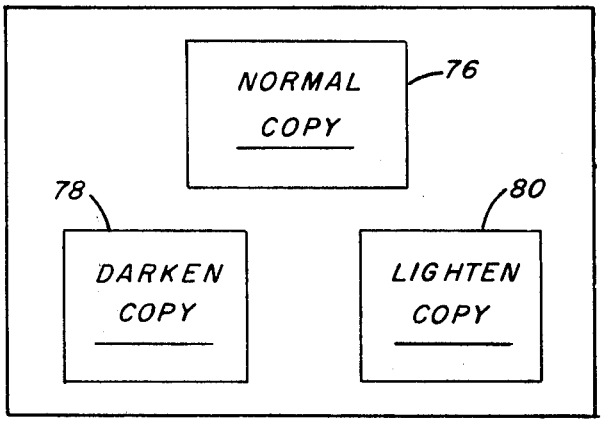

In FIG. 4, the operator controls include two rotary knobs, exposure knob 70 and contrast knob 72, the special print copy button 74, and the half-tone button 73. These controls are in addition to the normal, darken and lighten copy buttons 76, 78, and 80 usually found on copiers. Both knobs 70 and 72 have nine discrete positions.

The two control knobs 70 and 72 correspond to eighty-one sets which in turn correspond to different Din/Dout response curves. The first knob 70 functions as an exposure control and translates the breakpoint of the Din/Dout curve. When the knob 72 is turned, any one of nine different copy contrasts can be designated.

To make single or multiple copies (non-production run condition) of a document sheet and to obtain a copy representative of the conditions designated by the exposure and contrast knobs, and screening, the special print copy button 74 must be depressed. To activate the screen 13', an operator first depresses half-tone button 73. Thereafter he depresses the special print button 74. The depression of button 74 also causes the copy to be produced in accordance with the Eo, Vo and $V_B$ conditions specified by the knobs 70 and 72. In their respective positions 0.23 and 3.0, shown in FIG. 4, they are set to provide for a normal copy. The knobs 70 and 72 can be adjusted to change the copy contrast and density whether or not it is desired to activate the screen 13'.

If one of the normal, darken or lighten copy buttons is depressed, the computer ignores positions of the knobs 70 and 72, and a Din/Dout response curve corresponding to the normal, darken or lighten copy button designated will be produced. By means of this arrangement, a casual operator can choose to make copies by the conventional normal, darken or lighten copy button selection method.

OPERATION (AND SET-UP)

In operation, let us assume a special case where only one document sheet in a document stack needs special consideration for contrast and density control. An operator would remove this sheet from the document stack and depress the page select button 75 (FIG. 4). He then depresses the appropriate numbered buttons on the keyboard 35 which enters in memory 32 the position of the sheet in the document stack. In a document feeder which feeds last document sheet first, this position information is the position from the bottom of the document stack. Alternatively, the page number (from the top of the document stack) may be specified, along with the number of pages in the document so that position from the bottom of the document stack can be calculated by the LCU 31. Alternatively, the feeder may cycle through the document once for counting purposes. The operator then would make a copy of the document as previously described. If the document sheet is, for example, a photograph, he may decide that the half toning is appropriate. It, of course, may not be desirable. Let us assume, in this example, this improves the contrast but the copy still has some objectionable background; he then adjusts knobs 70 and 72 and makes another copy. Assuming now that the copy has the desired contrast and density, the operator would then press the starred button of the keyboard 35. The LCU 31 now enters into temporary memory 32 all the processing parameter information, i.e., activate screen, and the position (selected by knobs 70 and 72) in the matrix array corresponding to desired Vo, Eo, and $V_B$ values. In a more general case, if there were other document sheets that needed special consideration, the above iterative process would be repeated for each of them. The operator now inserts the removed document sheet and into the document and places such document in the feeder 50. He also returns knobs 70 and 72 to their normal position, if it is desired to make the other copies at this setting. The special print selection button is now depressed, and the feeder 50 and copier operate as previously described to produce a production run of collated copies of the multi-sheet document with each the copy corresponding to the particular document sheet having contrast and density in accordance with the stored process information and the remaining copies having normal contrast and density.

The invention has been described with particular reference to a preferred embodiment thereof, but it will be understood that variations and modifications can be effected within the spirit and scope of the invention. For example, rather than removing the document sheet needing special consideration from the multi-sheet document to make a master copy, the multi-sheet document can be inserted in the feeder. The feeder then can individually feed each document sheet to the exposure platen. An operator then can activate a screen and/or adjust the levels of the voltage Vo applied onto the photoconductor, the copier exposure Eo, and the bias $V_B$ applied to the development station electrode and make a copy. Copying of the document sheet is repeated until a copy with the desired contrast and density is produced. The position of the document sheet in the multi-sheet document and whether or not a screen is to be activated and the values corresponding to the optimum Vo, Eo, and $V_B$ levels are then stored in memory in accordance with the procedure described above. The document sheet is then returned by the feeder to the top of the stack. The process is repeated for all the document sheets. After all the sheets have been fed once and returned to the stack, the feeder and copier are then ready to make a production run, with each copy having desired contrast and density.

What is claimed is:

1. In apparatus for producing copies of a multi-sheet document which includes at least one sheet having a copy characteristic that is substantially different from the other sheets, said copier including adjustable control means for varying at least one copy process parameter to change copy contrast and density, and means for feeding seriatim the sheets of a multi-sheet document to a copying position to produce copies of the document, the improvement comprising:

(a) memory means for storing production run signals corresponding to (i) the number of copies to be made of a multi-sheet document, (ii) the copy process parameters for said multi-sheet document including the variation in said one copy process parameter for said one sheet, and (iii) the position of said one sheet in the multi-sheet document; and (b) logic and control means responsive to said signals for operating said feeding means to sequentially feed the sheets of said multi-sheet document to said copying position and for setting said adjustable control means prior to copying said one sheet to produce copies of the document, with each copy of a document sheet having a desired contrast and density.

2. The invention as set forth in claim 1 wherein said apparatus includes a chargeable photoconductor, and said adjustable control means includes adjustable charging means for varying the voltage Vo applied onto the photoconductor, an adjustable exposure station for varying the copier exposure Eo and a development station having at least one electrode and adjustable bias means for applying adjustable bias voltage $V_B$ to said electrode.

3. The invention as set forth in claim 1 or 2 wherein said photoconductor has an integral screen and said control means includes exposure producing means for activating said screen.

4. In apparatus including a feeder coupled to a copier having a chargeable photoconductor, for producing production run copies of a multi-sheet document which includes at least one sheet having a copy characteristic that is substantially different from the other sheets, said copier including adjustable control means for activating a screen to change copy contrast and density, and said feeder being adapted to feed seriatim the sheets of a multi-sheet document to a copying position in the copier to produce copies of the document, the improvement comprising:

(a) memory means for storing production run signals corresponding to (i) the number of copies to be made of a multi-sheet document, (ii) screen activation for said one sheet, and (iii) the position of said one sheet in the multi-sheet document; and (b) logic and control means responsive to said signals for operating said feeding means to sequentially feed the signals of said multi-sheet document to said copying position and for activating said screen when copying said one sheet to produce copies of the document with each copy of a document sheet having a desired contrast and density.

5. The invention as set forth in claim 2 wherein said photoconductor has an integral screen and said control means includes activating means for illuminating said screen.

6. The invention as set forth in claim 4 or 5 wherein said adjustable control means including adjustable charging means for varying the voltage Vo applied onto the photoconductor, an adjustable exposure station for varying the copier exposure Eo, and a development station having at least one electrode and adjustable bias means for applying adjustable bias voltage $V_B$ to said electrode.

7. For use with a recirculating feeder which receives a multi-sheet document stack which includes at least one document sheet having a copy characteristic that is substantially different from the other sheets, and a copier which produces production runs having predetermined number of copies of the multi-sheet document and wherein the recirculating feeder sequentially circulates document sheets to the copier exposure platen and back to the stack, the copier including adjustable means for varying at least one copier process parameter to change copy contrast and density, a production run control apparatus comprising;

(a) memory means for storing production run signals corresponding to (i) the number of copies to be made of a multi-sheet document, (ii) the copy process parameters for said multi-sheet document including the variation in said one copy process parameter for said one sheet, and (iii) the position of said one sheet in the multi-sheet document; and (b) logic and control means responsive to said signals for operating said feeding means to sequentially feed the sheets of said multi-sheet document to said copying position and for setting said adjustable control means prior to copying said one sheet to produce a production run of copies of the document, with each copy of a document sheet having a desired contrast and density.

8. In apparatus including a feeder coupled to a copier having a chargeable photoconductor with an image recording area and an integral halftone screen in the photoconductor forming on said area a plurality of charge islands, said apparatus producing production run copies of a multi-sheet document which includes at least one sheet having a copy characteristic that is substantially different from the other sheets, said copier including adjustable control means for activating a screen to change copy contrast and density, and said feeder feeding seriatim the sheets of a multi-sheet document to a copying position in the copier to produce copies of the document, the improvement comprising:

(a) memory means for storing production run signals corresponding to (i) the number of copies to be made of a multi-sheet document, (ii) screen activation for said one sheet, and (iii) the position of said one sheet in the multi-sheet document; and (b) logic and control means responsive to said signals for operating said feeding means to sequentially feed the sheets of said multi-sheet document to said copying position and for activating said screen when copying said one sheet to produce said number of copies of the document with each copy of a document sheet having a desired contrast and density.

9. The invention as set forth in claim 8 wherein said feeder is a recirculating feeder and said adjustable control means includes adjustable charging means for varying the voltage Vo applied onto the photoconductor, an adjustable exposure station for varying the copier exposure Eo, and a development station having at least one electrode and adjustable bias means for applying adjustable bias voltage $V_B$ to said electrode.

10. A method of operating a feeder and a copier having a photoconductor with an integral screen to make a production run of a multi-sheet document, comprising the steps of:

(a) automatically feeding document sheets seriatim to an exposure station of the copier and forming latent electrostatic images of such document sheets on image areas of the photoconductor;

(b) exposing said photoconductor before, during, or after forming one of said images which corresponds to a particular document sheet having a copy contrast characteristic different from other document sheets to activate said screen and create a plurality of charge islands in an image area in addition to any charge islands that result from the image forming step (a);

(c) developing said images; and (d) transferring such developed images to image receiving mediums such as copy sheets.

11. Method of making copies of a multi-sheet document using copier having adjustable control means for varying at least one copy process parameter to change copy contrast and density for a document sheet having a copy characteristic different from other document sheets and memory means for storing production signals, comprising the steps of:

(a) storing in the memory means production signals corresponding to (i) the number of copies to be made of a multi-sheet document, (ii) the copy process parameters for said multi-sheet document including the variation in said one copy process parameter for said one sheet, and (iii) the position of said one sheet in the multi-sheet document; and (b) copying each sheet of the document a number of times and setting said control means prior to copying said one sheet to produce a production run of copies of the document with each copy of each document sheet having a desired contrast and density.

12. In apparatus for producing copies of a multi-sheet document which includes at least one sheet having a copy characteristic that is substantially different from the other sheets, said copier including adjustable control means for varying at least one copy process parameter to change copy contrast and density, and means for feeding seriatim the sheets of a multi-sheet document to a copying position to produce a copy of such document, the improvement comprising:

(a) memory means for storing signals corresponding to (i) the copy process parameters for said multi-sheet document including the variation in said one copy process parameter for said one sheet, and (ii) the position of said one sheet in the multi-sheet document; and (b) logic and control means responsive to said signals for operating said feeding means to sequentially feed the sheets of said multi-sheet document to said copying position and for setting said adjustable control means prior to copying said one sheet to produce a copy of the multi-sheet document, with each document sheet copy having a desired contrast and density.

* * * * *

UNITED STATES PATENT AND TRADEMARK OFFICE

CERTIFICATE OF CORRECTION

PATENT NO. : 4,294,536

DATED : October 13, 1981

INVENTOR(S) : Kenneth B. Paxton

It is certified that error appears in the above—identified patent and that said Letters Patent is hereby corrected as shown below:

Column 11, line 66, "signals" should read -- sheets --.

Signed and Sealed this

*Twenty-second* Day of *December 1981*

[SEAL]

*Attest:*

GERALD J. MOSSINGHOFF

*Attesting Officer*

*Commissioner of Patents and Trademarks*